US005532643A

United States Patent [19]

Kuffner et al.

[11] Patent Number: 5,532,643

[45] Date of Patent: Jul. 2, 1996

[54] MANUFACTURABLY IMPROVED ASYMMETRIC STRIPLINE ENHANCED APERTURE COUPLER

[75] Inventors: Stephen L. Kuffner, Algonquin; Eric L. Krenz, Crystal Lake, both of Ill.

[73] Assignee: Motorola, Inc., Schaumburg, Ill.

[21] Appl. No.: 494,205

[22] Filed: Jun. 23, 1995

[51] Int. Cl.[6] ..... H01P 5/02

[52] U.S. Cl. ..... 333/246; 333/116; 343/700 MS

[58] Field of Search ..... 333/116, 246; 343/700 MS

[56] References Cited

U.S. PATENT DOCUMENTS

| | | | |
|---|---|---|---|
| 3,581,243 | 5/1971 | Alford | 333/116 |
| 3,665,480 | 5/1972 | Fassett | 343/754 |
| 3,771,075 | 11/1973 | Phelan | 333/246 |
| 3,827,054 | 7/1974 | Herskind | 343/708 |
| 4,737,740 | 4/1988 | Millican et al. | 333/116 |
| 5,175,560 | 12/1992 | Lucas et al. | 343/767 |

*Primary Examiner*—Paul Gensler
*Attorney, Agent, or Firm*—Kevin A. Buford

[57] ABSTRACT

A manufacturably improved asymmetric stripline enhanced aperture coupler (10) is provided including a first non-transverse electromagnetic (non-TEM) field which couples an asymmetric stripline transmission line (22) to a coupling conductor (19) through a first aperture (17) in a first ground plane (16). The coupler (10) suppresses a second non-TEM field formed as an image on a second ground plane (15) by reducing the current flow on the second ground plane (15) using the asymmetric stripline transmission line (22) with increased coupling between a stripline conductor (12) and first ground plane (16) relative to coupling between stripline conductor (12) and second ground plane (15), particularly in the vicinity of the second non-TEM field using second aperture (14). The second non-TEM field is suppressed so as to enhance the coupling effect of the first non-TEM field between asymmetric stripline transmission line (22) and a coupling conductor (19).

13 Claims, 2 Drawing Sheets

MANUFACTURABLY IMPROVED ASYMMETRIC STRIPLINE ENHANCED APERTURE COUPLER

BACKGROUND OF THE INVENTION

This invention relates in general to aperture couplers, and more particularly, asymmetric stripline aperture couplers.

In applications where a microstrip patch antenna is used, coupling to the patch antenna typically presents an undesirable manufacturing process. One method that is commonly used makes direct contact to the patch antenna with a center conductor of a coaxial cable, with a shield of the coaxial cable connected to a ground plane associated with the patch antenna. This method is not compatible with an automated surface mount assembly process. A plated via can be used in place of the center conductor of the coaxial cable, but a layer of dielectric material must be used between the patch antenna and the ground plane associated with the patch antenna. If a low cost, typically lossy, dielectric is used, a reduction in antenna efficiency results.

To avoid manufacturing problems and the loss of antenna efficiency associated with direct contact methods, non-contacting methods have been developed. These methods rely on electromagnetic field coupling techniques which are compatible with surface mount assembly processes and are essentially lossless. One non-contacting method which has been used is known as a proximity feed. Microstrip line, extended beneath the patch antenna for a short distance, provides a coupling mechanism through the parasitic capacitance existing between the microstrip line and the patch antenna. Radiation from the microstrip line has the undesirable effect of degrading the radiation pattern of the patch antenna.

One solution to eliminating the undesired degradation of the radiation pattern of the patch antenna due to the proximity feed is an aperture fed patch antenna in which the patch antenna and the microstrip line are separated by a microstrip ground plane with a small opening. The opening serves as an aperture aligned with the microstrip conductor beneath the patch. A non-transverse electromagnetic (non-TEM) field formed in the vicinity of the aperture couples the patch antenna to the microstrip line. The aperture fed patch antenna may be used with a simple radio transceiver which does not demand multilayer circuit board techniques to support higher system complexity.

To support higher system complexities, multi-layer circuit board constructs require stripline rather than microstrip. A simple extension of the aperture fed patch antenna method using stripline transmission line simply provides an additional ground plane separated from the microstrip line, now a stripline conductor, by a dielectric. The addition of another ground plane has the benefit of isolating the stripline conductor from additional layers, but also provides an image of the non-TEM field formed by the aperture in the opposite ground plane. The image degrades the intensity of the non-TEM field and thus reduces the coupling effects of the non-TEM field.

One method for suppressing the degrading effects of the image replaces the dielectric in the vicinity between the stripline conductor and the aperture with a dielectric plug of substantially higher dielectric constant than the dielectric between the stripline conductor and the ground plane with the aperture. The higher dielectric constant of the plug concentrates electric field intensity between the stripline conductor and the ground plane in the vicinity of the aperture. This enhances the non-TEM field used for coupling, and suppresses the image field which degrades coupling.

Placing the high dielectric plug between the stripline conductor and the ground plane in the vicinity of the aperture complicates the assembly and increases the number of parts required to produce the assembly, both of which add to the cost of the assembly. An easily manufactured low cost stripline aperture coupler with enhanced coupling would be beneficial for use in multilayer circuit board applications.

DETAILED DESCRIPTION OF THE DRAWINGS

Figure 1:
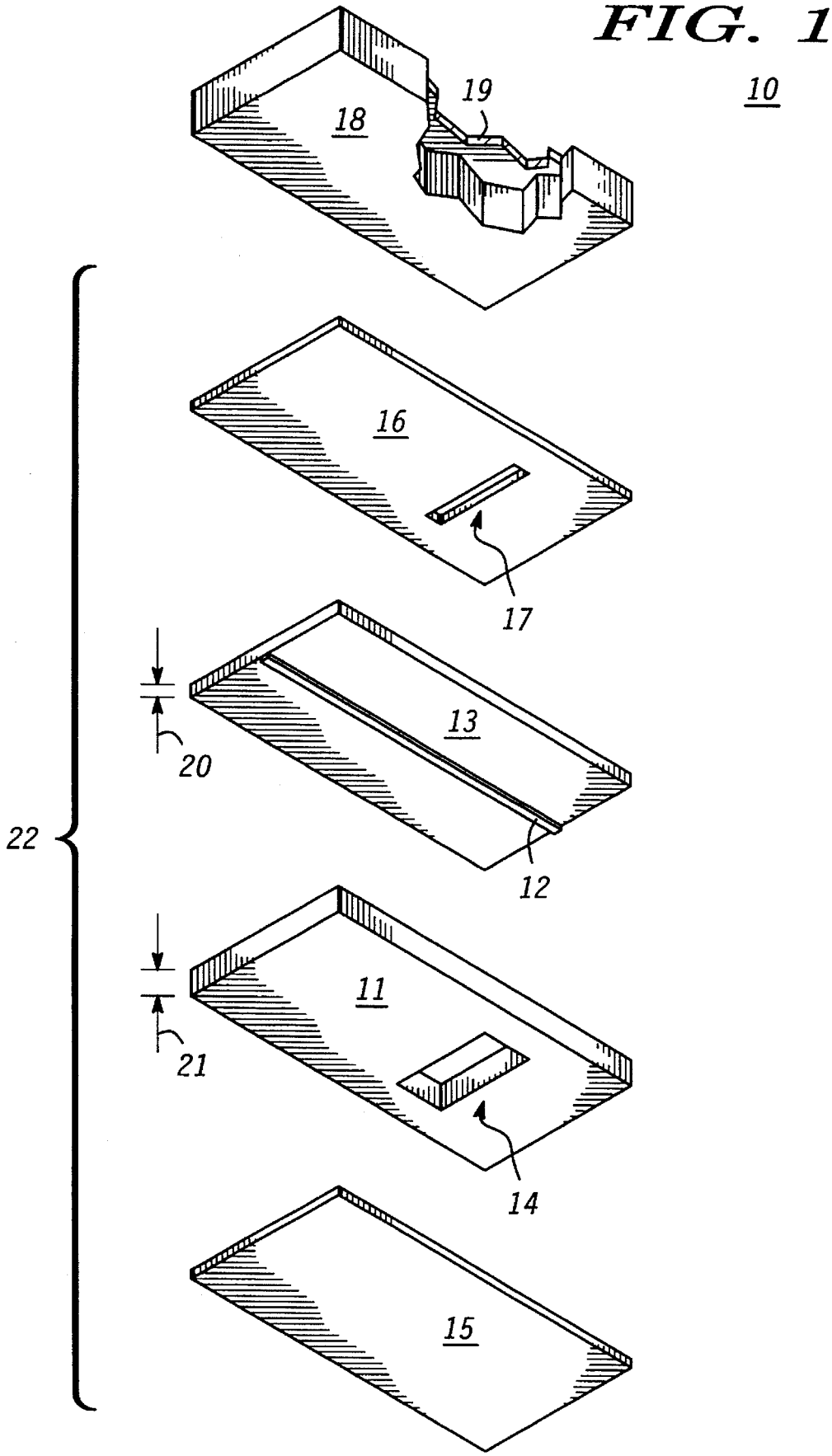
FIG. 1 is an exploded view of a manufacturably improved asymmetrical stripline enhanced aperture coupler.

Referring to FIG. 1, the basic structure of a manufacturably improved asymmetric stripline enhanced aperture coupler according to the invention is represented in an exploded view. Asymmetric stripline aperture coupler 10 comprises a first dielectric 13, a second dielectric 11, and a stripline conductor 12 disposed between second dielectric 11 and first dielectric 13. A first ground plane 16 is separated from stripline conductor 12 by first dielectric 13 and a second ground plane 15 is separated from stripline conductor 12 by second dielectric 11. A first aperture 17 is formed within first ground plane 16 and a second aperture 14 is formed within second dielectric 11. A third dielectric 18 is separated from first dielectric 13 by first ground plane 16 and a coupling conductor 19 is separated from first ground plane 16 by third dielectric 18.

Asymmetric stripline transmission line 22 differs from symmetric stripline transmission line (not shown) in that the stripline conductor is separated from first and second ground planes using first and second dielectrics with different electrical characteristics. The asymmetric stripline shown is formed by separating stripline conductor 12 from first ground plane 16 using first dielectric 13 and separating stripline conductor 12 from second ground plane 15 using second dielectric 11. Forming stripline conductor 12 may be accomplished using conventional double-sided circuit board, methods to define conductor dimensions on a side of first dielectric 13. Forming stripline conductor 12 on first dielectric 13 is preferred since formation of second aperture 14 within second dielectric 11 may impose manufacturing problems if stripline conductor 12 were formed on second dielectric 11.

First dielectric 13 has a first dielectric height 20 and a first dielectric constant. Second dielectric 11 has a second dielectric height 21 and a second dielectric constant. In a first embodiment of the invention, both first dielectric 13 and second dielectric 11 have a first dielectric constant and a second dielectric constant equal to a dielectric constant of 4 times the dielectric constant of free space. To change electrical characteristics of first dielectric 13 and second dielectric 11, second dielectric height 21 is greater than first dielectric height 20. In an alternate embodiment (not shown), first dielectric 13 has a first dielectric constant which is significantly higher than the second dielectric constant of second dielectric 11. Using dielectrics of different dielectric constants allows both first dielectric height 20 and second dielectric height 21 to be equal, with different electrical characteristics.

First aperture 17 is formed in first ground plane 16 by removing conductive material from first ground plane 16 within a region defining first aperture 17. The region defining first aperture 17 is generally rectangular in shape with a high apect ratio of a length dimension and a width dimension of at least four to one. The length dimension of first aperture 17 is typically less than one half of a wavelength, and generally approximately one quarter of a wavelength, a wavelength being defined at a frequency of operation within first dielectric 13. First aperture 17 is formed on a side of first dielectric 13 opposite stripline conductor 12. The length dimension of first aperture 17 is oriented at a right angle in first ground plane 16 with respect to a length dimension of stripline conductor 12. First dielectric 13 is generally available with rolled copper or other metals or depositions on both sides. The side opposite stripline conductor 12 serves as first ground plane 16 with metal defining the region of first aperture 17 removed using conventional double-sided circuit board methods. First aperture 17 is positioned in alignment between stripline conductor 12 and coupling conductor 19.

Second aperture 14 is formed in second dielectric 11 and positioned in alignment with first aperture 17 and stripline conductor 12. Second dielectric 11 has a second dielectric constant and second aperture 14 has an aperture dielectric constant. Second aperture 14 is formed by altering the second dielectric constant of second dielectric 11 to the aperture dielectric constant within a region defining second aperture 14. A feature of the invention is that the second dielectric constant may be altered to the aperture dielectric constant by removing dielectric material. Manufacturing methods may be used to remove material from second dielectric 11 thereby leaving an opening in second dielectric 11.

Removing dielectric material from second dielectric 11 replaces the second dielectric constant of second dielectric 11 with a dielectric constant equal to the dielectric constant of free space. Removing dielectric material to reduce the second dielectric constant to the aperture dielectric constant is the preferred method since the preferred method is low cost and easily manufacturable. Other means of altering the first dielectric constant of second dielectric 11 which render the aperture dielectric constant in the region defining second aperture 14 to a substantially lower value relative to the first dielectric constant may be used.

The region defining second aperture 14 is generally rectangular and has a length dimension and a width dimension. The length dimension of second aperture 14 is greater than the length dimension of first aperture 17, and oriented in parallel with the length dimension of first aperture 17. The width dimension of second aperture 14 is typically about one quarter of a wavelength at the frequency of operation within asymmetric stripline transmission line 22. The quarter wavelength width dimension of second aperture 14 provides impedance transformation between a stripline mode of propagation supported by asymmetric stripline transmission line, and a covered microstrip mode of propagation which is supported in the region defining second aperture 14.

Coupling conductor 19 is any conductor suitable for coupling to asymmetric stripline aperture coupler 10 such as a microstrip patch antenna, or a stripline or a microstrip conductor.

Separating coupling conductor 19 from first aperture 17 using third dielectric 18 provides necessary isolation between coupling conductor 19 and ground plane 16 to allow coupling conductor 19 to be electromagnetically coupled. Aligning coupling conductor 19 with stripline conductor 12 and first aperture 17 allows coupling conductor 19 to be coupled through first dielectric 13, aperture 17, and third dielectric 18 to stripline conductor 12. A specific design of first aperture 17 and second aperture 14, will be dependent on electrical characteristics primarily of first dielectric 13, second dielectric 11, third dielectric 18 and coupling conductor 19. Mathematical expressions describing electromagnetic fields of asymmetric stripline aperture coupler 10 are sufficiently complex that computer aided design techniques including use of some type of three-dimensional electromagnetic field simulation software are recommended.

A description of the operation of asymmetric stripline aperture coupler 10 proceeds as follows. According to the invention, the method of enhancing coupling of asymmetric stripline transmission line 22 to coupling conductor 19 includes forming an asymmetric stripline transmission line 22 having first aperture 17 and second aperture 14. The method further includes forming a first non-transverse electromagnetic (non-TEM) field using first aperture 17 while suppressing a second non-TEM field opposing the first non-TEM field. To enhance coupling, asymmetric stripline aperture coupler 10 enhances the first non-TEM field by suppressing the second non-TEM field using the asymmetric stripline transmission line 22 and second aperture 14. Asymmetric stripline transmission line 22 couples to coupling conductor 19 using the first non-TEM field.

RF energy propagates in a transverse electromagnetic (TEM) mode or a quasi-TEM mode supported by asymmetric stripline transmission line 22. Asymmetric stripline transmission line 22 comprises stripline conductor 12 separated from second ground plane 15 by second dielectric 11 and separated from first ground plane 16 by first dielectric 13. RF currents are formed on first ground plane 16 and second ground plane 15 in opposite directions to currents which form on stripline conductor 12. A sum of magnitudes of currents on first ground plane 16 and second ground plane 15 is equal in magnitude to current on stripline conductor 12.

Differences in electrical characteristics of second dielectric 11 and first dielectric 13 cause the magnitudes of currents on first ground plane 16 and second ground plane 15 to be unequal. In forming the asymmetric stripline transmission line 22, stripline conductor 12 is coupled more strongly to first ground plane 16 than second ground plane 15 because of differences in relative dielectric heights 20 and 21, relative dielectric constants of first dielectric 13 and second dielectric 11, or both.

A feature of the invention is that asymmetric stripline 22 increases coupling of stripline conductor 12 to first ground plane 16 and increases current magnitude on first ground plane 16. Increasing coupling of stripline conductor 12 to first ground plane 16 correspondingly reduces coupling of stripline conductor 12 to second ground plane 15. Reducing coupling of stripline conductor 12 to second ground plane 15 reduces current magnitude on second ground plane 15 relative to current magnitude on first ground plane 16. A feature of the invention is that aperture 14 with a substantially lower dielectric constant than second dielectric 11, further reduces the current flow on second ground plane 15 in the vicinity of the second non-TEM field.

First aperture 17 is formed as an opening in first ground plane 16. Current flow on first ground plane 16 toward aperture 17 is forced to split, flow around first aperture 17, and converge as the current flows away from first aperture 17. The first non-TEM field is formed as the result of current flow around first aperture 17. The first non-TEM field induces currents on second ground plane 15 which form the second non-TEM field on second ground plane 15 as an image of the first non-TEM field. The second non-TEM field opposes the first non-TEM field and tends to cancel the first non-TEM field. The reduced current flow on second ground plane 15, further reduced in the vicinity of second aperture 14, substantially suppresses the second non-TEM field in magnitude relative to the first non-TEM field. Suppressing the second non-TEM field reduces the tendency of the second non-TEM field to cancel the first non-TEM field.

Figure 2:
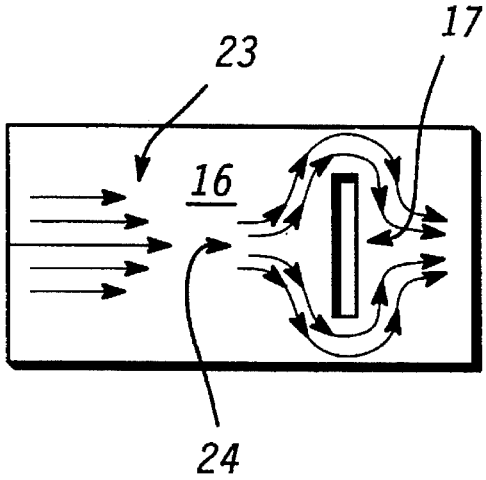
FIG. 2 is a view describing current flow on a first ground plane.

FIG. 2 illustrates how current flows on first ground plane 16 around aperture 17. Arrows 23 represent current flow on first ground plane 16. The relative lengths of arrows 23 indicate relative current magnitudes. FIG. 2 shows current magnitudes with the longest of arrows 23 corresponding to center alignment with stripline conductor 12, and gradually shorter arrows corresponding to either sides of stripline conductor 12. Aligning first aperture 17 between stripline conductor 12 and coupling conductor 19, such that first aperture 17 is centered relative to stripline conductor 12 (see FIG. 1) and coupling conductor 19, yields the greatest magnitude of first non-TEM field for a given magnitude of current flowing on first ground plane 16. Referring again to FIG. 2, current as indicated by arrows 24 on first ground plane 16 approaches aperture 17, splits as indicated by arrows 24, flows around aperture 17, and converges flowing away from aperture 17.

Figure 3:
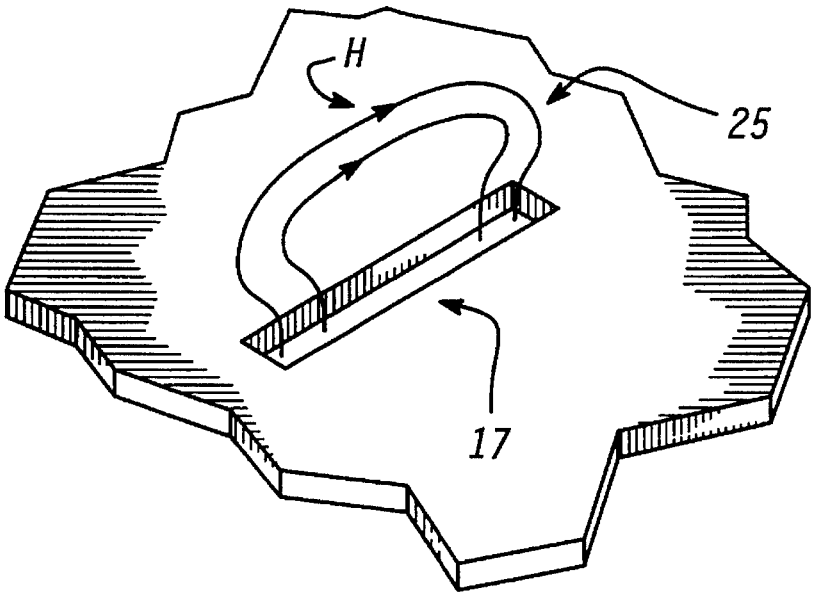
FIG. 3 is a view illustrating a magnetic field of a first non-transverse electromagnetic field.

As current flow is forced to bend around aperture 17, the first non-TEM field is induced having solenoidal magnetic field lines as indicated by arrows 25 shown in FIG. 3. The first non-TEM field penetrates through third dielectric 18 (see FIG. 1) from first aperture 17 to coupling conductor 19. Aligning the region defining second aperture 14 with first aperture 17 and stripline conductor 12 assures that currents on ground plane 16 which are induced by the first non-TEM field are minimized. Reducing the coupling of stripline conductor 12 to second ground plane 15 using asymmetric stripline transmission line reduces the currents induced on second ground plane 15. Further reducing the coupling of stripline transmission line 12 to ground plane 15 using second aperture 14 minimizes the currents induced by the first non-TEM field. Suppressing the second non-TEM field by minimizing the currents induced on second ground plane 15 by the first non-TEM field reduces cancellation by the second non-TEM field on the first non-TEM field. Reducing the cancellation on the first non-TEM field enhances coupling of the first non-TEM field to coupling conductor 19.

The opening in first ground plane 16 which forms aperture 17 allows the first non-TEM field, formed inside asymmetric stripline transmission line 22 to extend outside asymmetric stripline transmission line 22. The first non-TEM field couples asymmetric stripline transmission line 22 to coupling conductor 19 through the opening in first ground plane 16. In an application of asymmetric stripline aperture coupler 10, coupling conductor 19 is formed as a microstrip patch antenna. A magnetic component of the first non-TEM field emanating from first aperture 17 through third dielectric 18 excites a desired transverse magnetic field of a radiating mode of the patch antenna. The radiating mode of the patch antenna when receiving RF energy, by reciprocity couples the patch antenna with asymmetric stripline aperture coupler 10.

In another application, coupling conductor 19 forms either a microstrip transmission line using third dielectric 18 and first ground plane 16, or a second stripline conductor of a second stripline transmission line with the inclusion of a fourth dielectric and a third ground plane. The magnetic component of the first non-TEM field excites a desired transverse magnetic field of a TEM mode of operation of the microstrip transmission line or the second stripline transmission line.

It should be appreciated by now that asymmetric stripline aperture coupler 10 provides a low cost multilayer circuit board coupler. Asymmetric stripline aperture coupler 10 provides a first non-TEM field which couples asymmetric stripline transmission line 22 to a coupling conductor 19 through first aperture 17 in first ground plane 16. Asymmetric stripline aperture coupler 10 enhances the first non-TEM field by suppressing the second non-TEM field formed as an image on second ground plane 15. The second non-TEM field is suppressed by reducing the current flow on second ground plane 15. Current flow on second ground plane 15 is reduced using asymmetric stripline transmission line 22 with increased coupling between stripline conductor 12 and first ground plane 16 relative to coupling between stripline conductor 12 and second ground plane 15. Current flow on second ground plane 15 is reduced particularly in the vicinity of the second non-TEM field using second aperture 14. The second non-TEM field is suppressed because the second non-TEM field degrades coupling of the first non-TEM field between asymmetric stripline transmission line 22 and coupling conductor 19.

We claim:

1. An asymmetric stripline aperture coupler comprising:

a stripline conductor;

a first ground plane having a first aperture;

a first dielectric disposed between the stripline conductor and the first ground plane;

a second ground plane;

a second dielectric disposed between the stripline conductor and the second ground plane having a second aperture;

a third dielectric; and a coupling conductor separated from the first ground plane by the third dielectric.

2. The coupler of claim 1 wherein the first dielectric has a first dielectric height and a first dielectric constant.

3. The coupler of claim 2 wherein the second dielectric has a second dielectric height and a second dielectric constant with at least one of the second dielectric height and the second dielectric constant being different than the first dielectric height and the first dielectric constant.

4. The coupler of claim 1 wherein the first aperture is positioned in alignment between the stripline conductor and the coupling conductor.

5. The coupler of claim 4 wherein the second aperture is positioned in alignment with the first aperture and the stripline conductor.

6. The coupler of claim 1 wherein the second aperture has an aperture dielectric constant.

7. A method of forming an asymmetric stripline aperture coupler comprising the steps of:

forming a stripline transmission line having a first ground plane, a stripline conductor and a second ground plane;

separating the first ground plane from the stripline conductor using a first dielectric;

forming a first aperture in the first ground plane;

separating the second ground plane from the stripline conductor using a second dielectric;

forming a second aperture in the second dielectric;

providing a coupling conductor; and separating the coupling conductor from the first ground plane using a third dielectric.

8. The method of claim 7 wherein forming the first aperture includes removing conductive material from the first ground plane within a region defining the first aperture.

9. The method of claim 8 wherein forming the first aperture includes aligning the region defining the first aperture between the stripline conductor and the coupling conductor.

10. The method of claim 7 wherein forming the second aperture includes altering a second dielectric constant of the second dielectric to an aperture dielectric constant within a region defining the second aperture.

11. The method of claim 10 wherein altering the second dielectric constant includes removing dielectric material from the second dielectric.

12. The method of claim 10 wherein forming the second aperture includes aligning the region defining the second aperture with the first aperture and the stripline conductor.

13. The method of claim 7 wherein forming the coupling conductor includes aligning the coupling conductor with the stripline conductor and the first aperture.

* * * * *